US008342148B2

(12) United States Patent
Liimatta et al.

(10) Patent No.: US 8,342,148 B2
(45) Date of Patent: Jan. 1, 2013

(54) THROTTLE VALVE FOR INTERNAL COMBUSTION ENGINE

(75) Inventors: Gary Liimatta, Ypsilanti, MI (US); Brent Hall, Grand Blanc, MI (US); Milan Dockery, Brighton, MI (US)

(73) Assignee: Ford Global Technologies, Dearborn, MI (US)

( * ) Notice: Subject to any disclaimer, the term of this patent is extended or adjusted under 35 U.S.C. 154(b) by 1289 days.

(21) Appl. No.: 11/307,059

(22) Filed: Jan. 20, 2006

(65) Prior Publication Data

US 2007/0170391 A1 Jul. 26, 2007

(51) Int. Cl.
*F02D 1/00* (2006.01)

(52) U.S. Cl. ..... 123/336; 251/305

(58) Field of Classification Search ..... 123/336, 123/337; 251/305, 308

See application file for complete search history.

(56) References Cited

U.S. PATENT DOCUMENTS

| | | | | |
|---|---|---|---|---|
| 2,876,984 | A * | 3/1959 | Reppert | 251/175 |
| 2,974,921 | A * | 3/1961 | Kaswan | 251/58 |
| 4,103,866 | A * | 8/1978 | Robinson | 251/151 |
| 4,526,051 | A * | 7/1985 | Kraus | 476/10 |
| 4,562,993 | A * | 1/1986 | Lew | 251/161 |
| 5,096,156 | A * | 3/1992 | Wylie et al. | 251/77 |
| 5,971,026 | A | 10/1999 | Beran | |
| 5,979,872 | A * | 11/1999 | Stearns et al. | 251/305 |
| 6,138,988 | A | 10/2000 | Bouvet et al. | |
| 6,354,267 | B1 * | 3/2002 | Kotchi et al. | 123/337 |
| 6,522,038 | B2 | 2/2003 | Byram | |
| 6,598,854 | B1 | 7/2003 | Jessberger et al. | |
| 6,612,325 | B2 * | 9/2003 | Rentschler et al. | 137/15.25 |
| 6,708,949 | B2 * | 3/2004 | Twito | 251/305 |
| 6,837,261 | B2 * | 1/2005 | Rentschler et al. | 137/315.22 |
| 6,840,260 | B2 | 1/2005 | von Willich | |
| 6,854,711 | B2 | 2/2005 | Krause | |
| 6,871,631 | B2 * | 3/2005 | Bender | 123/337 |
| 7,063,303 | B2 * | 6/2006 | Makino et al. | 251/214 |
| 7,069,902 | B2 * | 7/2006 | Arai et al. | 123/337 |
| 7,111,609 | B2 * | 9/2006 | Tanimura et al. | 123/337 |
| 7,117,845 | B2 * | 10/2006 | Iwaoka et al. | 123/337 |
| 7,137,614 | B2 * | 11/2006 | Masui et al. | 251/129.11 |
| 7,168,682 | B2 * | 1/2007 | Nanba et al. | 251/305 |
| 7,240,691 | B2 * | 7/2007 | Bevan | 137/554 |
| 2007/0063163 | A1 * | 3/2007 | Yeary et al. | 251/305 |

FOREIGN PATENT DOCUMENTS

| | | |
|---|---|---|
| EP | 1200722 | 7/2000 |

* cited by examiner

*Primary Examiner* — John Kwon
(74) *Attorney, Agent, or Firm* — Jerome R. Drouillard; Julia Voutyras

(57) ABSTRACT

A throttle valve for an internal combustion engine includes a cylindrical valve housing and a spherical segment valve disc mounted within the valve housing. The spherical segment valve disc seals with the valve housing without the need for abutting interference between the valve disc or throttle plate and the valve housing.

20 Claims, 3 Drawing Sheets

THROTTLE VALVE FOR INTERNAL COMBUSTION ENGINE

BACKGROUND OF THE INVENTION

The present invention relates to an air throttle valve for controlling the air flowing through an internal combustion engine, such as a spark ignited or compression ignition internal combustion engine.

Throttle valves have been used with internal combustion engines for well over a century. Most commonly used throttle valves include a round or oval plate, usually made of brass or aluminum. The throttle plate extends through a slotted, or slab cut, rotatable shaft which passes through the walls of an air passage. Typically, the air passage may be incorporated in a device such as a throttle body for use within a fuel injected engine; alternatively, the air passage may be incorporated into the housing of a mixing device such as a carburetor. Throttle devices with oval plates rely upon a nearly line-on-line contact between the majority of the throttle blade periphery and the throttle housing to achieve a near-zero or low airflow condition corresponding to engine idle operation. However, to avoid sticking of the throttle plate it is necessary to maintain a clearance between the throttle plate and the bore within which the plate is housed. Unfortunately, it is very difficult to achieve a precise low flow condition with conventional valve geometry, because air leakage through the clearance regions causes widely varying airflow.

A throttle valve assembly according to present invention solves problems inherent with known throttle valves by providing a throttle plate having a spherical section which rides directly upon the throttle bore, so as to provide superior sealing of the throttle plate in the bore. Because the spherical section throttle plate has only a single defining dimension, the orientation issues arising with other plate geometries are avoided.

SUMMARY OF THE INVENTION

A throttle valve for internal combustion engine includes a generally cylindrical valve housing having inside diameter and a throttle plate pivotally mounted within the valve housing. The throttle plate includes a valve disc having an outer rim shaped as a spherical segment, with the valve disc having an outside diameter proximate the inner diameter of the valve housing. Pivots extend through apertures formed in the valve housing and into contact with the valve disc. The present throttle valve further includes a sensor for determining the rotational position of the throttle plate and a motor assembly for positioning a throttle plate. In a preferred embodiment, the throttle plate and the generally cylindrical valve housing may be formed from the same type of powdered metal, such as powdered iron, or other types of powdered or other metals known to those skilled in the art and suggested by this disclosure. The valve disc and valve housing may advantageously be coated with a manganese phosphate finish which impedes corrosion while serving as a break-in coating of the parts.

In order to operate the present assembly efficiently, the motor assembly may include a motor connected with a double or triple reduction gear train.

According to another aspect of the present invention, valve disc used in the present throttle body includes a ring-shaped structure surrounding a thinner circular core. The ring-shaped structure has an outer diameter shaped as a spherical segment, which allows the present valve disc to rotate within the throttle valve body or housing without binding or sticking.

According to another aspect of the present invention, the valve body or housing may be formed as a two piece assembly by separating a preform along fracture path extending through pivot apertures formed in the preform.

According to another aspect of the present invention, the valve disc may have integral and unitary pivots or, alternatively, the valve disk may have trunnions for accepting pivots inserted inwardly through apertures formed in the valve housing.

It is an advantage of a system according to the present invention that airflow to an engine may be very precisely controlled, notwithstanding the presence of contamination of the throttle bore, or extreme thermal gradients.

It is a further advantage of a system according to the present invention that the present throttle system may be manufactured without a need for excessive hand fitting of throttle valve discs within throttle valve bores.

It is a further advantage of a system according to the present invention that the throttle body and throttle valve may be constructed of the same material, so as to avoid problems with uneven thermal growth of the components.

It is a further advantage of a system according to the present invention that the present throttle valve assembly is more compact than known throttle valves, and is therefore useful for technical applications including not only main air throttles, but also manifold control valves and other air-routing and controlling applications. For this reason, as used herein, the terms "throttle valve" and "throttle system" refer to all of the previously enumerated types of air valves.

It is a further advantage of a system according to the present invention that the present throttle valve assembly is more resistant to damage from thermal excursions, such as those experienced either during backfire events or with engines operated with high exhaust gas recirculation (EGR) rates.

Other advantages, as well as features and objects of the present invention, will become apparent to the reader of this specification.

DETAILED DESCRIPTION OF THE PREFERRED EMBODIMENT

Figure 1:
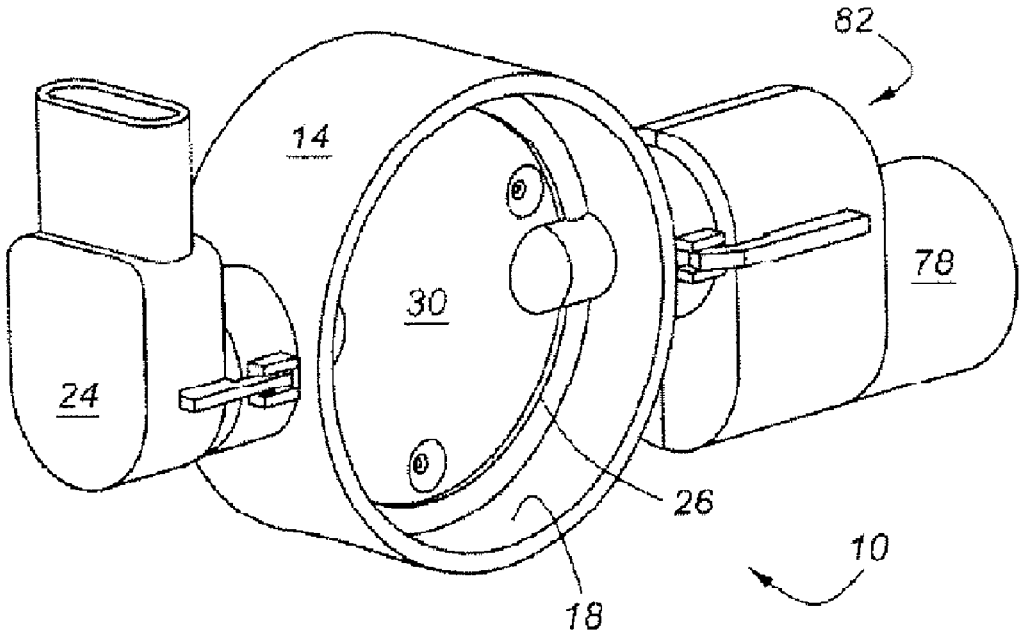
FIG. 1 is a perspective view of an assembled throttle valve according to the present invention.
Figure 2:
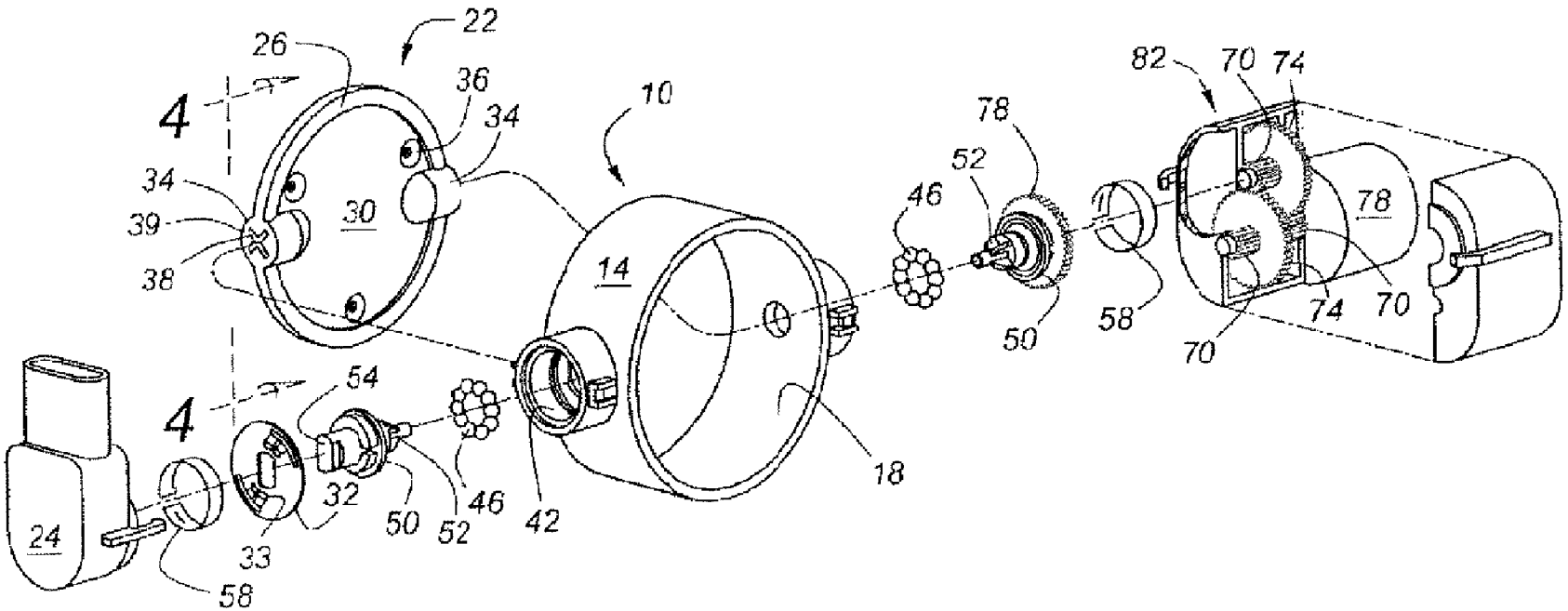
FIG. 2 is an exploded perspective view of the throttle valve shown in FIG. 1.
Figure 3:
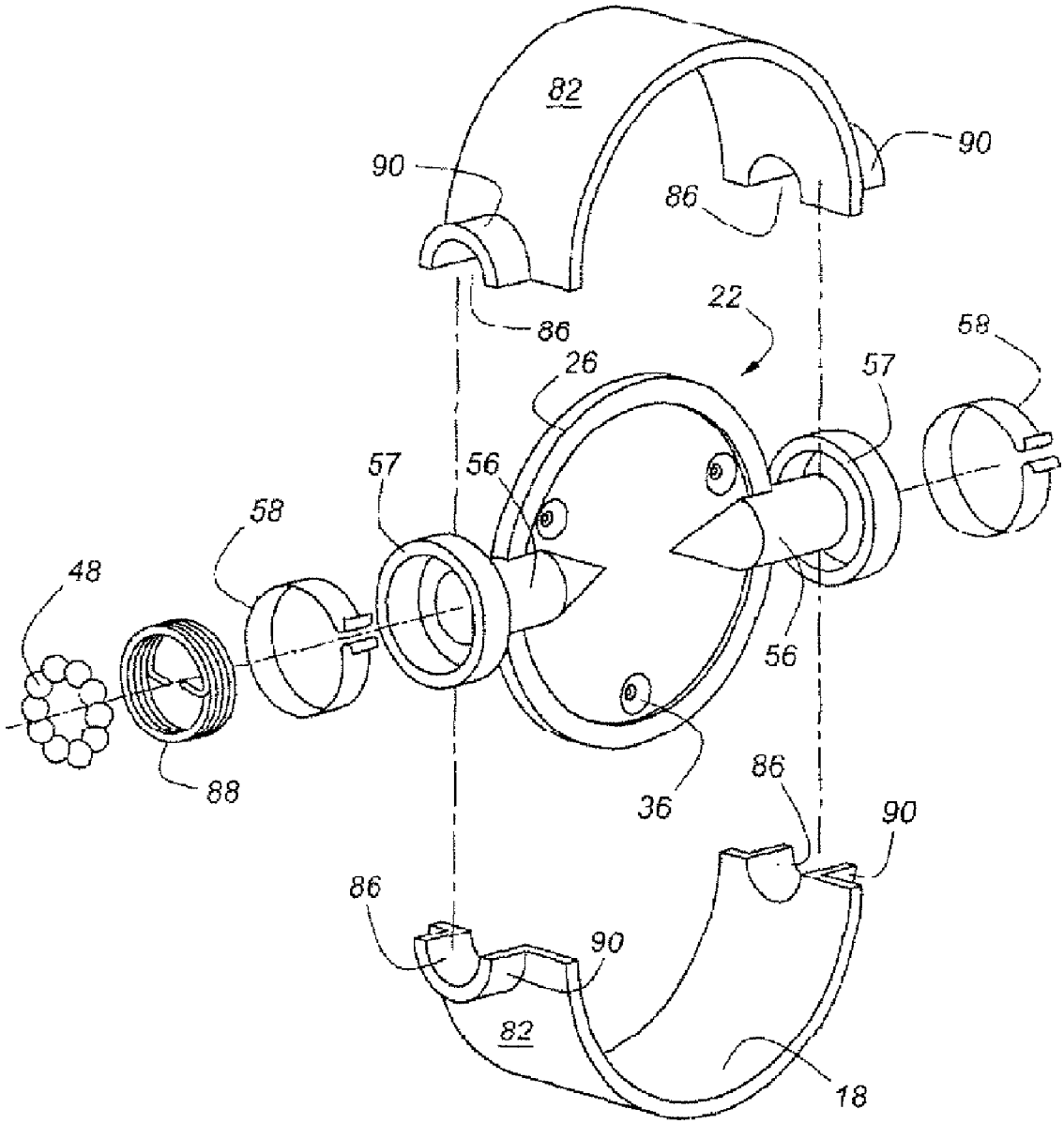
FIG. 3 is an exploded view of a portion of a second type of throttle valve according to the present invention.

As shown in FIGS. 1 and 2, valve assembly 10 has valve housing 14, with inside diameter 18. Bearing races 42 (FIG. 2) provide housings for a plurality of bearing balls 46 which allow stub shafts 50 to pivot with respect to valve housing 14. Throttle position sensor 24 and housing 82, which mounts throttle positioning motor 78, are located on opposite sides of valve housing 14. As shown in FIG. 3, each stub shaft 50 accommodates additional hardware. In one case, rotor 32, including brushes 33 of throttle position sensor 24, is locked to one of stub shafts 50. On the opposite side of valve assembly 10, stub shaft 50 is locked to gear 78, which is mounted within housing 82 and ultimately driven by motor 78.

Valve assembly 10 is useful for employment with a drive-by-wire system in which the control of an engine throttle is achieved solely by means of electronics, as opposed to a more conventional mechanical cable assembly. Because valve housing 14 is generally cylindrical, the housing may be mounted conveniently in an air induction system or, even in an air inlet manifold, without the need for additional threaded fasteners.

FIGS. 1 and 2 also show throttle plate, or valve disc, 22, which has an outer rim illustrated as a ring-shaped structure, 26, which surrounds circular core 30. This construction is shown more particularly in section in FIG. 4. Rim 26 is shaped as a spherical segment having an outside diameter which is slightly less than the inside diameter 18 of valve housing 14. Because outer rim 26 of throttle plate 22 is shaped as a spherical segment, throttle plate 22 is resistant to becoming corked or stuck in the closed position within valve housing 14, as sometimes occurs with known throttle plates.

Figure 4:
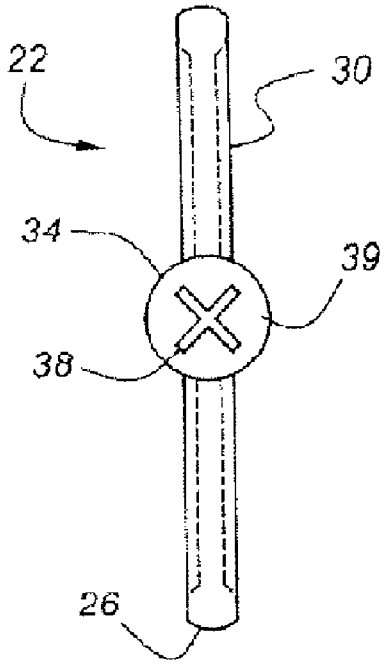
FIG. 4 is an end elevation of a throttle plate according to one aspect of the present invention.

Throttle plate 22 has two trunnions, 34, formed integrally with ring-shaped structure 26 and circular core 30. As shown in FIG. 4, each of trunnions 34 has a female spline, 38, formed therein, which matches and is engaged by splines 52 formed at the inboard end of each of stub shafts 50. Acting together, female spline 38, and male spline 52 assure that throttle plate 22 is not free to rotate except as driven by motor 78 and gear train 66. Each of trunnions 34 has an outer surface, 39, which contacts the inner diameter 18 of housing 14. Because surfaces 39 are spherical segments having the same radius of curvature as the outermost surface of ring-shaped structure 26, surfaces 39 may ride freely upon inner diameter 18, while at the same time providing optimal airflow control, particularly at the idle airflow position. Throttle plate 22 has three locating depressions 36 formed therein. Depressions 36 provide a convenient structure for mounting throttle plate 22 in a machine tool during manufacturing of the throttle plate.

Throttle disc 22 and valve housing 14 may advantageously be coated with a manganese phosphate finish which impedes corrosion, while serving as a break-in coating for these parts. The manganese phosphate coating also serves as an abradable seal between disc 22 and inner diameter 18 of housing 14.

FIG. 3 illustrates a second embodiment of a throttle valve assembly according to present invention in which throttle plate 22 has integral stub shafts 56, which are cast in place with the balance of throttle plate 22. In order to permit mounting of throttle plate 22 within housing 82 upon pivot apertures 86, housing 82 is formed as a two-piece assembly manufactured by separating a preform along fracture paths extending within shoulders 90 and through pivot apertures 86 Housing 82 is assembled by means of retainers 57 and snap rings 58, which fit about shoulders 90. Bearings 48 are provided to allow pivoting action of throttle plate 22 within housing 82. Torsion spring 88 urges throttle plate 22 to its idle airflow position. Either one or two such torsion springs would be employed with the embodiment of FIGS. 1 and 2.

Notwithstanding that ball bearings 46 and 48 are shown with the various embodiments of the present invention, other types of antifriction bearings, or even plain bearing elements, could be used to practice present invention.

The inventors of the present throttle valve determined that the valve may be advantageously constructed from powdered metal such as ferrous or non-ferrous metals, or alternatively, other metallic or non-metallic composites or die or pressure-cast metals known to those skilled in the art and suggested by this disclosure. One advantageous combination is powdered iron, used for both throttle plate 22 as well as for housings 14 and 82. Forming throttle plate 22 and housings 14 and 82 from the same material will avoid problems due to differential thermal expansion, while allowing the spherical outer surface of throttle plate 22 to be finished by grinding to a very fine surface detail, including the outboard-most surfaces, 39, of trunnions 34. In this manner, the outer portions of trunnions 34 will remain in contact with valve housing 14 when valve disk 22 is rotated by the throttle operator, in this case motor 78 and gear train 66.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. A throttle valve for an internal combustion engine, comprising:

a generally cylindrical valve housing having an inside diameter; and a throttle plate pivotally mounted within said valve housing, with said throttle plate comprising:

a valve disc having an outer rim shaped as a spherical segment, with said disc having an outside diameter proximate the inner diameter of said valve housing; and a plurality of pivots extending through apertures formed in said valve housing and into contact with said disc.

2. A throttle valve according to claim 1, further comprising a sensor for determining the rotational position of said throttle plate, with said sensor being operatively connected with at least one of said plurality of pivots.

3. A throttle valve according to claim 1, further comprising a motor assembly for positioning said throttle plate, with said motor assembly being operatively connected with at least one of said plurality of pivots.

4. A throttle valve according to claim 1, wherein said throttle plate is formed from powdered metal.

5. A throttle valve according to claim 4, wherein said throttle plate is formed from powered iron.

6. A throttle plate according to claim 1, wherein said valve housing is formed from powdered metal.

7. A throttle valve according to claim 6, wherein said valve housing is formed from powdered iron.

8. A throttle valve according to claim 3, wherein said motor assembly comprises a motor operatively connected to a gear reduction system which is operatively connected with said throttle plate.

9. A throttle valve according to claim 8, wherein said gear reduction system comprises a triple reduction gear train.

10. A throttle valve according to claim 1, wherein said outer rim of said valve disc comprises a ring-shaped structure surrounding a thinner, circular core.

11. A throttle valve according to claim 1, wherein said valve housing comprises a two-piece assembly formed by separating a perform along fracture paths extending through said pivot apertures.

12. A throttle valve according to claim 11, wherein each of said plurality of pivots is integral and unitary with sad valve disc.

13. A throttle valve according to claim 1, wherein each of said plurality of pivots comprises a stub shaft extending inwardly through one of said apertures formed in said valve housing and into one of a plurality of trunnions formed in said valve disc.

14. A throttle valve for an internal combustion engine, comprising:

a generally cylindrical valve housing having a circular inside diameter; and a throttle plate pivotally mounted within said valve housing, with said throttle plate comprising:

a disc having an outer rim shaped as a spherical segment, with said disc having an outside diameter proximate the inner diameter of said valve housing; and a pair of trunnions incorporated within said disc at diametrically opposite locations;

a plurality of pivots extending through apertures formed in said valve housing and into said trunnions; and a throttle operator, connected with at least one of said pivots, for positioning said throttle plate.

15. A throttle valve according to claim 14, further comprising a plurality of antifriction bearing elements interposed between said pivots and races formed in opposing portions of a said valve housing.

16. A throttle valve according to claim 14, wherein said valve housing and said valve disc comprise powdered ferrous metal.

17. A throttle valve according to claim 14, wherein said valve housing and said valve disc comprises powdered metal coated with a manganese phosphate finish.

18. A throttle valve according to claim 14, wherein said trunnions are finished as part of the spherical segment comprising said throttle plate such that an outer portion of each of said trunnions remains in contact with said valve housing when said valve disc is rotated by said throttle operator.

19. A throttle valve according to claim 14, wherein said plurality of pivots comprises at least one pivot having a throttle position sensor rotor incorporated therein.

20. A throttle valve according to claim 14, wherein said plurality of pivots comprises at least one pivot having a reduction gear component incorporated therein.

* * * * *